US007926576B2

(12) United States Patent
Rock et al.

(10) Patent No.: US 7,926,576 B2
(45) Date of Patent: Apr. 19, 2011

(54) COILED TUBING RIG

(75) Inventors: Devin Rock, Katy, TX (US); Rod Shampine, Houston, TX (US); Marc Allcorn, Sugar Land, TX (US); Brent Nickerson, Calgary (CA); Bartley Patton, Sugar Land, TX (US); Takahiro Kosaka, Anchorage, AK (US); Matt Rouse, Baton Rouge, LA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 134 days.

(21) Appl. No.: 11/690,998

(22) Filed: Mar. 26, 2007

(65) Prior Publication Data

US 2007/0221386 A1 Sep. 27, 2007

Related U.S. Application Data

(60) Provisional application No. 60/743,818, filed on Mar. 27, 2006.

(51) Int. Cl.
*E21B 19/22* (2006.01)

(52) U.S. Cl. ..... 166/380; 166/77.1; 166/77.2

(58) Field of Classification Search ..... 166/380, 166/77.1, 77.2, 77.3, 77.4, 356
See application file for complete search history.

(56) References Cited

U.S. PATENT DOCUMENTS 6,182,765 B1 2/2001 Kilgore
6,488,093 B2 * 12/2002 Moss ..... 166/339
6,659,180 B2 12/2003 Moss
6,672,407 B2 * 1/2004 Streich ..... 175/58
6,763,889 B2 7/2004 Rytlewski
6,901,998 B1 6/2005 Roodenburg
6,973,979 B2 * 12/2005 Carriere et al. ..... 175/203
7,036,598 B2 * 5/2006 Skjaerseth et al. ..... 166/339
7,165,619 B2 1/2007 Fox
7,188,547 B1 3/2007 West
7,631,705 B1 * 12/2009 Harte et al. ..... 175/59
2005/0279511 A1 * 12/2005 Adnan et al. ..... 166/380
2006/0283587 A1 * 12/2006 Wood et al. ..... 166/77.2
2007/0284113 A1 * 12/2007 Haheim ..... 166/345
2008/0296065 A1 * 12/2008 Standal ..... 175/52

OTHER PUBLICATIONS

Casseeet. al., "True Hybrid Operations Combining Coiled Tubing Drilling and Conventional Rig Workover Techniques and Practices", Reel Reporter, Newsletter of the INternational Coiled Tubing Association, vol. 9, Issue 2, pp. 2-9 (May 2004).*

* cited by examiner

*Primary Examiner* — William P Neuder
*Assistant Examiner* — Elizabeth C Gottlieb
(74) *Attorney, Agent, or Firm* — Michael M. Dae; David Cate; Robin Nava

(57) ABSTRACT

A technique for utilizing a coiled tubing rig improves its operation and functionality. The coiled tubing rig is adapted to enable improved operation in a variety of harsh environments. The coiled tubing rig also may comprise features that facilitate the interchangeability of well tools, e.g. the interchangeability of bottom hole assemblies, to lower operational cost and to increase the efficiency with which a variety of well related operations can be performed.

20 Claims, 2 Drawing Sheets

COILED TUBING RIG

This non-provisional patent application claims priority to provisional application Ser. No. 60/743,818 filed Mar. 27, 2006.

BACKGROUND

Coiled tubing rigs are used for a variety of well related operations. Generally, coiled tubing rigs are used to deliver a variety of well tools downhole and/or to perform a variety of well related procedures via coiled tubing or jointed tubing. Coiled tubing is unspooled and injected into a wellbore to move a well tool, e.g. a bottom hole assembly, to a desired position downhole. Similarly, the coiled tubing and attached well tool can be retrieved from the well by spooling the coiled tubing onto a coiled tubing reel. A variety of factors, including environmental factors and the interchangeability of well tools, can limit the efficiency of the coiled tubing rig and otherwise detrimentally affect operation of the coiled tubing rig.

SUMMARY

In general, the present invention provides a system and method for improving the functionality and efficient operation of a coiled tubing rig. The rig comprises one or more features that facilitate its operation in many types of environments, including harsh environments. Alternatively, or in addition, the coiled tubing rig may comprise one or more features that facilitate the interchangeability of well tools, e.g. the interchangeability of bottom hole assemblies. The ease of interchangeability lowers operational cost and increases the efficiency of performing a variety of well related operations.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for utilizing a coiled tubing rig. The coiled tubing rig comprises one or more transportable components that are moved to one or more selected well sites to perform well related procedures. The transportable components often are placed on movable platforms, such as road legal trailer beds, that can be transported over public highways. In this manner, the coiled tubing rig components can be easily moved from to one well site to another to perform, for example, well servicing operations.

Generally, the coiled tubing rig may be equipped to handle both tubing joints and coiled tubing as well as a variety of downhole components, e.g. bottom hole assemblies. The coiled tubing rig comprises a mast that can be transitioned to a vertical orientation to facilitate the lifting of tubing, well tools and other well related components. The mast also can be used in corporation with, for example, a lubricator and a coiled tubing injector. Transportable coiled tubing reels enable coiled tubing to be rapidly deployed or retrieved via the coiled tubing injector. Additionally, many other or alternate components can be used with or incorporated into the coiled tubing rig to facilitate a variety of well servicing operations.

Figures 1, 2:
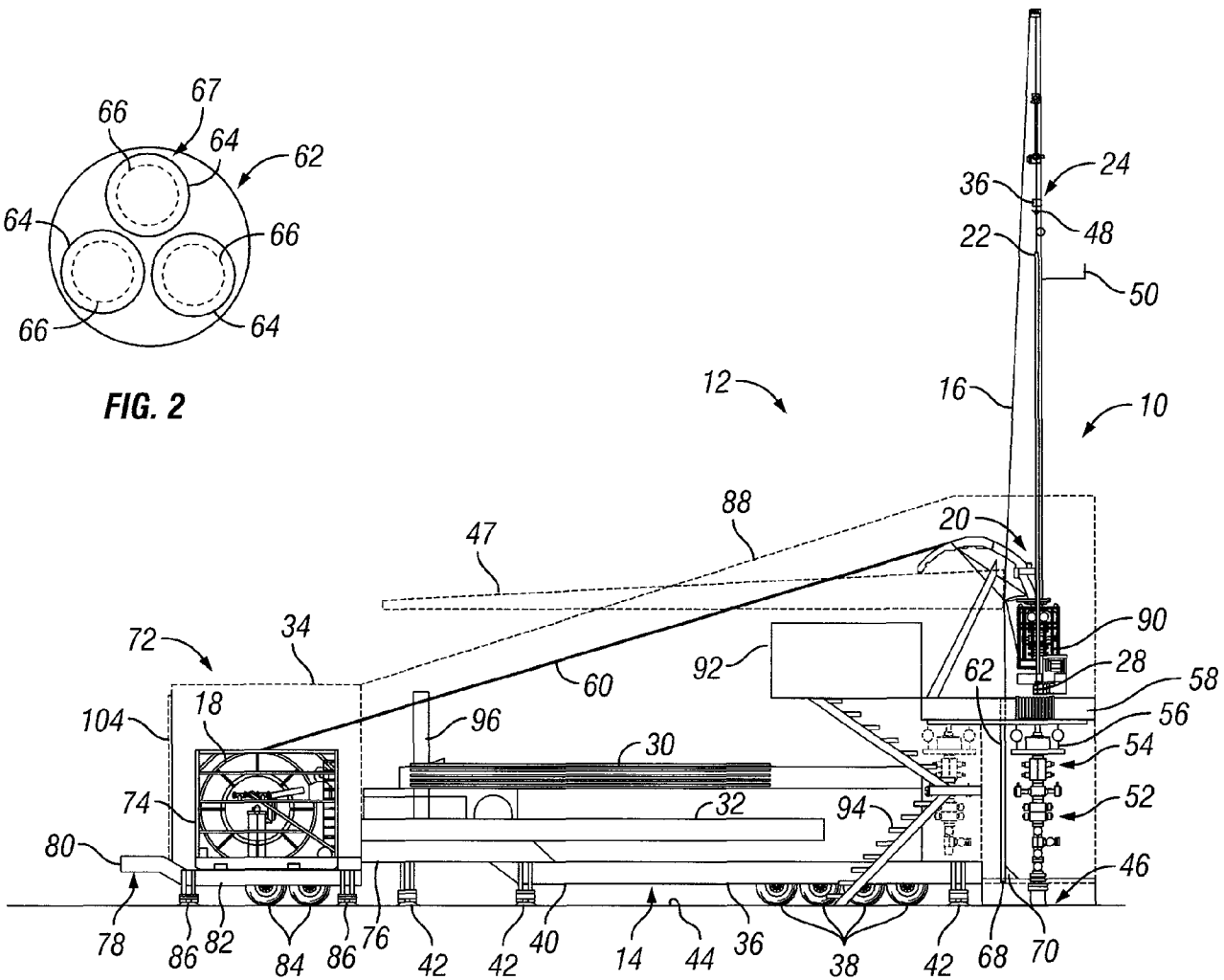
FIG. 1 is a side view of a coiled tubing rig located at a well site, according to an embodiment of the present invention.
FIG. 2 is a top view of a mouse hole utilized with the coiled tubing rig illustrated in FIG. 1, according to an embodiment of the present invention.

One embodiment of a coiled tubing rig 10 is illustrated in FIG. 1 as positioned at a well site 12. In this example, coiled tubing rig 10 comprises a base or platform 14, a mast 16 mounted to base 14, and a coiled tubing reel 18. Additionally, coiled tubing rig 10 comprises a coiled tubing injector 20, a lubricator 22, a lubricator handling system 24 having upper and lower lubricator handling arms 26, 28, and jointed pipe 30 that may be manipulated by a pipe elevator 32. Coiled tubing reel 18 is positioned in a coiled tubing reel housing 34, and lubricator handling system 24 may be used to select and move well tools, e.g. bottom hole assemblies, into cooperation with lubricator 22, as discussed in greater detail below.

In the embodiment illustrated, base 14 comprises a trailer 36 having a plurality of wheels 38 supporting a trailer platform 40 to enable movement of coiled tubing rig 10 from one well site to another. Trailer 36 may be designed as a road legal trailer to allow legal transport over a public highway system. Base 14 also may comprise a plurality of stabilizer arms 42 that can be lowered and pressed against a ground surface 44 to stabilize the overall system when mast 16 is raised for a coiled tubing rig operation.

Mast 16 is pivotably mounted to base 14 so the mast may be raised to facilitate coiled tubing rig operations at a well 46. Upon completion of the well related operation, mast 16 can be pivoted to a generally horizontal position for transport, as illustrated by the mast outline 47 in FIG. 1. Mast 16 is used in cooperation with a variety of components, such as lubricator 22. Additionally, lubricator handling system 24 may be mounted to mast 16 in a manner that facilitates the handling of bottom hole assemblies and lubricators without extending the mast height. In this embodiment, lubricator 22 is held upright in the mast by handling arms 26, 28 or similar devices. Mast 16 also can be used in cooperation with other components, such as a lubricator winch 48 and a fingerboard 50.

When raised, mast 16 is positioned above a well installation 52 mounted over well 46. Well installation 52 may comprise a variety of conventional components, such as blowout preventers 54, illustrated as engaged by a blowout preventer handling system 56. Blowout preventer handling system 56 may be coupled to a rig floor section 58 of base 14 that is positioned below mast 16.

The coiled tubing injector 20 is mounted for rotation through multiple positions, e.g. a position over well center and a position out of alignment with well center. The coiled tubing injector 20 may be mounted on rig floor section 58 for the rotating movement without requiring removal of coiled tubing 60 from the coiled tubing injector. When the coiled tubing injector 20 is rotated out of alignment with the well center, the lubricator 22 and bottom hole assemblies or other downhole equipment can be maneuvered over the well center above well 46.

For example, lubricator handling system 24 can be used to manipulate lubricator 22 over well 46. In the illustrated embodiment, lubricator handling system 24 can be used to move lubricator 22 vertically along mast 16. Additionally, lubricator handling system 24 can be used to retrieve downhole equipment, e.g. bottom hole assemblies, from a mouse hole 62 for deployment into well 46. The lubricator handling system 24, via handling arms 26, 28, can be pivoted between a plurality of positions, e.g. an over the well position, an over the mouse hole position, and an at-rest position. Accordingly, the lubricator handling system can be pivoted to mouse hole 62 for retrieval of selected bottom hole assemblies or other downhole equipment. The selected equipment is lifted from mouse hole 62 and moved into position over well 46 for deployment into the well.

As further illustrated in FIG. 2, mouse hole 62 comprises a plurality of cartridges/receptacles 64 that are each designed to receive a bottom hole assembly or other appropriate downhole equipment 66, as illustrated in dashed lines. By way of example, mouse hole 62 is illustrated as having three receptacles 64 with three corresponding bottom hole assemblies 66. However, the number of receptacles 64 can vary depending on the applications for which the coiled tubing rig is designed. Mouse hole 62 is an indexing mouse hole that indexes receptacles 64 and the corresponding bottom hole assemblies 66 into a proper retrieval position, e.g. retrieval position 67, for selection and retrieval by lubricator handling system 24.

The receptacles 64 can be moved to retrieval position 67 by a variety of mechanisms. For example, the receptacles 64 can be rotated to a desired angular position, and then the corresponding bottom hole assembly 66 can be lifted slightly for grasping by lubricator handling system 24. In other embodiments, the receptacles and bottom hole assemblies can be moved and/or lifted by different mechanisms and along different paths to enable retrieval by the lubricator handling system. In the example illustrated, a selected bottom hole assembly 66 is lifted slightly from its corresponding receptacle 64 by a wedge member 68 rotated by a motor 70, such as a hydraulic motor or stepper motor. As wedge member 68 is rotated beneath the bottom hole assembly 66, the wedge sufficiently lifts the desired bottom hole assembly to a position for grasping by the lubricator handling system. Additionally, motor 70 or other motors can be used to rotate receptacles 64 within mouse hole 62 to present the selected bottom hole assembly 66 at a desired angular position for easy retrieval.

Figure 3:
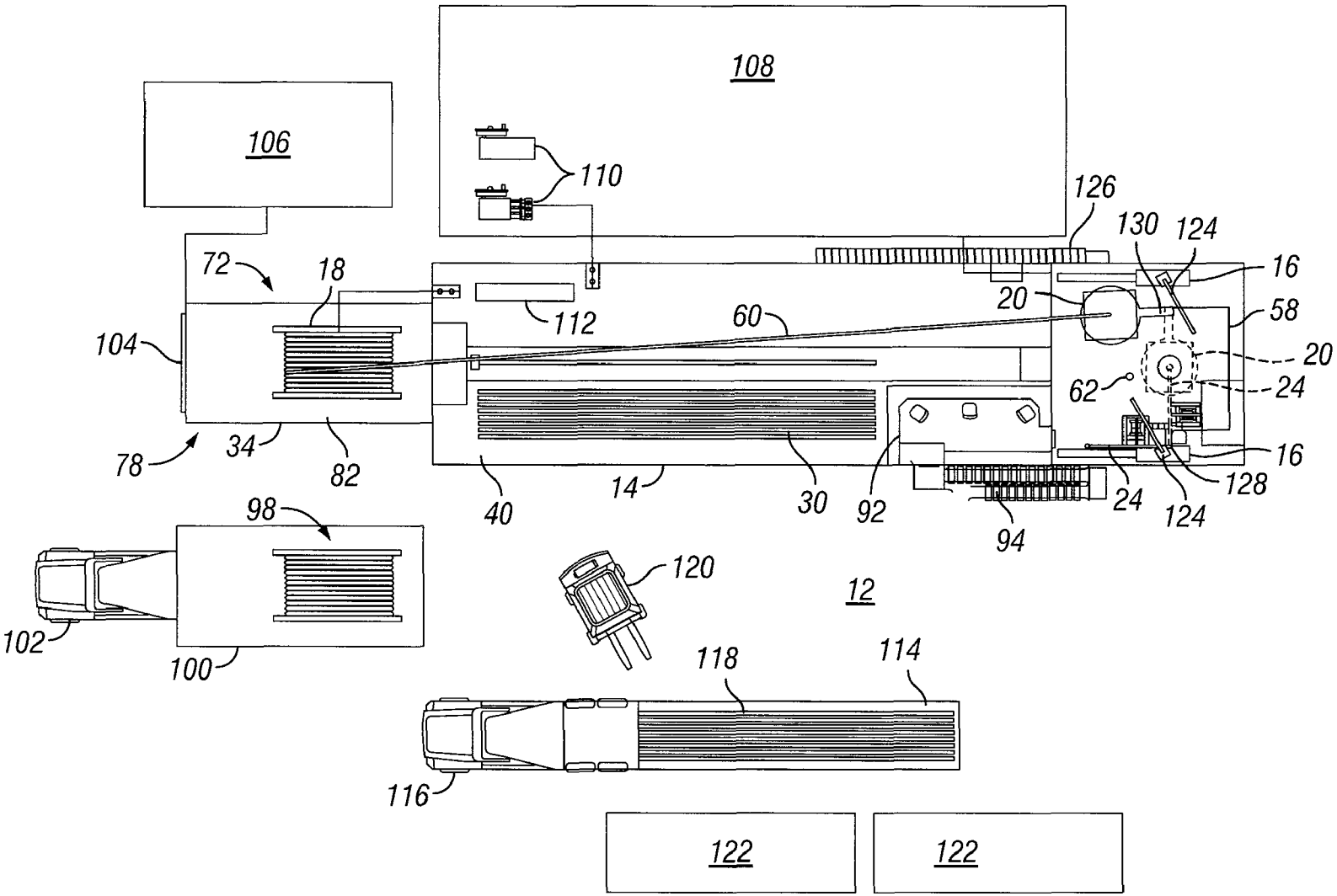
FIG. 3 is a plan view of a well site including the coiled tubing rig illustrated in FIG. 1 and additional support equipment, according to an embodiment of the present invention.

During coiled tubing operations, coiled tubing 60 is delivered to coiled tubing injector 20 from a coiled tubing module 72, as illustrated in FIGS. 1 and 3. Coiled tubing module 72 comprises coiled tubing reel 18 rotatably mounted on a mounting structure 74 within coiled tubing reel housing 34. Coiled tubing module 72 also is climate controlled to protect coiled tubing reel 18 and coiled tubing 60 from environmental factors, e.g. freezing temperatures. For example, housing 34 may be climate controlled by appropriate climate control equipment 76 positioned within coiled tubing module 72 or externally of coiled tubing module 72. Climate control equipment 76 may comprise a heater for heating coiled tubing reel housing 34 as well as other climate control equipment as desired for coiled tubing rig operations in specific environments.

In the embodiment illustrated, coiled tubing module 72 is mounted on a transportable platform 78. By way of example, transportable platform 78 may comprise a road legal trailer 80 having a trailer platform 82 supported on a plurality of wheels 84. The road legal trailer 80 also may comprise a plurality of stabilizer arms 86 to stabilize transportable platform 78 when positioned for operation at well site 12. In this embodiment, transportable platform 78 is positioned adjacent base 14 during the rig operations, as best illustrated in FIG. 1.

The coiled tubing 60 also may be protected from environmental elements by a protective structure 88. Protective structure 88 is a partial or full enclosure that protects the coiled tubing from environmental elements as it travels from coiled tubing module 72 to coiled tubing injector 20. Protective structure 88 also can be expanded to enclose coiled tubing 60 over its entire travel path from coiled tubing module 72 into well 46. Additionally, climate control equipment 76 or additional climate control equipment can be used to heat or otherwise control conditions within protective structure 88.

Depending on the type of well related operations for which coiled tubing rig 10 is utilized, a variety of other equipment and components can be mounted over base 14. For example, a slick line unit 90 can be mounted over rig floor section 58. An operations cabin 92 can be mounted above the base 14 and coupled to a stairway 94 that provides access to the operations cabin. The operations cabin can be used to control the assembly and deployment of coiled tubing rig 10 as well as operation of the coiled tubing rig once it is properly positioned over well 46. A mast rest 96 is located to support mast 16 when the well related operations are completed and the coiled tubing rig is converted to its transport configuration.

In addition to the equipment mounted on transportable base 14 and transportable platforms 78, a variety of other vehicles, components and equipment can be utilized in a coiled tubing rig well operation. As illustrated in FIG. 3, for example, a back up reel or reel module 98 can be mounted on a separate transportable platform 100 which may be transported by a suitable truck 102 over a public highway system. The backup reel 98 is interchangeable with coiled tubing reel 18 when needed. In the embodiment illustrated, coiled tubing reel housing 34 comprises a door 104 that may be opened to interchange coiled tubing reel 18 with the backup reel 98. Door 104 may be a role-up type door or other style of door that provides ready access to coiled tubing reel housing 34 for interchanging coiled tubing reels.

A generator 106 may be provided to provide power for climate control equipment 76 and to provide power for operating the various other systems of coiled tubing rig 10 and the systems supporting coiled tubing rig 10. By way of example, generator 106 may comprise a standard generator unit or suitable equipment for utilizing highline power from the electric grid. The use of standard generator units can reduce maintenance cost and improve service quality. The generator 106 also may be trailer mounted to facilitate its easy transport from one well site to another.

Furthermore, a fluid module 108 may be positioned adjacent base 14. By way of example, fluid module 108 comprises one or more mud pumps 110 fluidly coupled with coiled tubing 60 via a manifold 112. Fluid module 108 also may be trailer mounted to facilitate its movement between well sites.

Other equipment often utilized in well operations includes a flatbed trailer 114 transported by a suitable truck 116. Flatbed trailer 114 can be used to carry additional jointed pipe 118. The jointed pipe 118 is used to replace jointed pipe 30 as it is deployed downhole by coiled tubing rig 10. A forklift 120 or other suitable mechanism can be used to transfer jointed pipe 118 to base 14. Modular offices 122 also can be set up at well site 12, as necessary. The modular offices 122 are sized and designed for transport over the public highway system on suitable trailers.

A variety of other components and features also can be mounted on or over base 14 and its rig floor section 58. For example, one or more jib cranes 124 can be mounted at desired locations to facilitate movement of equipment needed in coiled tubing rig operations. Furthermore, additional stairways, e.g. stairway 126, can be positioned to provide rig operators with access to desired rig locations.

In FIG. 3, lubricator handling system 24 is illustrated as positioned in its parked or at-rest position. However the lubricator handling system 24 can be pivoted about its pivot axis 128 for selective movement to its position at mouse hole 62 and its position over well 46. Accordingly, lubricator handling system 24 can be used to rapidly move desired bottom hole assemblies or other downhole equipment from mouse hole 62 into position over well 46 or vice versa. Similarly, the coiled tubing injector 20 can be selectively pivoted, via an injector arm 130, between a position over the well (shown in dashed lines) and a position away from the well (shown in solid lines). As illustrated, the coiled tubing injector 20 is mounted independently of drilling mast 16. Injector arm 130 also can be designed to enable the raising and lowering of coiled tubing injector 20.

Depending on the specific coiled tubing rig operation, a variety of additional features can be incorporated into coiled tubing rig 10 and/or utilized at well site 12. The specific positioning of mouse hole 62 can be adjusted according to the arrangement of other cooperating components. Additionally, the design of the coiled tubing reel housing 34 as well as climate control equipment 76 can vary according to the specific applications anticipated. In extremely cold climates, for example, climate control equipment 76 can be designed to provide additional heating to ensure that the coiled tubing does not freeze and become blocked when flow through the coiled tubing is stopped.

Accordingly, although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method, comprising:

storing a plurality of bottom hole assemblies in a mouse hole formed in a coiled tubing rig;

indexing the plurality of bottom hole assemblies until a selected bottom hole assembly is presented at a retrieval position;

lifting the selected bottom hole assembly from a first position to a second position to facilitate retrieval by a lubricator handling system pivotally mounted to the coiled tubing rig;

retrieving the selected bottom hole assembly with the lubricator handling system; and moving the selected bottom hole assembly to a well position.

2. The method as recited in claim 1, wherein storing comprises storing three bottom hole assemblies in three corresponding receptacles.

3. The method as recited in claim 1, wherein indexing comprises rotating the plurality of bottom hole assemblies within the mouse hole.

4. The method of claim 1, further comprising:

placing a coiled tubing reel on a transportable platform for use in the coiled tubing rig;

enclosing the coiled tubing reel with a housing mounted on the transportable platform;

deploying coiled tubing from the coiled tubing reel to a coiled tubing injector;

protecting the coiled tubing from the environment as it moves between the housing and the coiled tubing injector with a separate protective structure extending between the coiled tubing reel module and the coiled tubing injector; and controlling the temperature within the housing.

5. The method as recited in claim 4, wherein enclosing comprises providing a door on the housing that may be opened to remove the coiled tubing reel from the housing.

6. The method as recited in claim 5, further comprising moving a back-up coiled tubing reel into the housing through the door.

7. The method as recited in claim 4, wherein controlling comprises raising the temperature.

8. The method as recited in claim 4, further comprising controlling the temperature within the protective structure.

9. The method as recited in claim 1, wherein lifting comprises lifting the bottom hole assembly by rotating a wedge beneath the bottom hole assembly to a position for grasping the bottom hole assembly by the lubricator handling system.

10. A well system, comprising:

a coiled tubing rig having:

a mouse hole system comprising a plurality of receptacles positioned in a mouse hole to receive bottom hole assemblies, the plurality of receptacles being indexable to a retrieval position;

a mast and a coiled tubing injector mounted on the coiled tubing rig; and a lubricator handling system pivotally mounted on the coiled tubing rig for movement along a pivot axis between the retrieval position and a position above a well, the lubricator handling system being able to retrieve a bottom hole assembly from the receptacle indexed to the retrieval position, wherein the coiled tubing injector is selectively pivotable between a position over the well and a position away from the well.

11. The well system is recited in claim 10, wherein the mouse hole system and the lubricator handling system are mounted on a transportable platform.

12. The well system as recited in claim 10, further comprising a coiled tubing reel module.

13. The well system as recited in claim 12, wherein the coiled tubing reel module comprises a coiled tubing reel disposed within a climate controlled housing.

14. The well system as recited in claim 10, wherein the lubricator handling system is mounted on the mast.

15. The well system as recited in claim 14, further comprising a lubricator, wherein the lubricator handling system is able to move the lubricator in a generally vertical direction along the mast.

16. The well system of claim 10, wherein the coiled tubing rig further comprises a coiled tubing reel module and a protective structure extending between the coiled tubing reel module and the coiled tubing injector to protect the coiled tubing from the environment, wherein the coiled tubing reel module comprises a coiled tubing reel disposed in a temperature controlled housing separate from the protective structure and the coiled tubing rig.

17. The system as recited in claim 16, wherein the temperature controlled housing comprises a door that may be opened to allow interchanging of coiled tubing reels.

18. The system as recited in claim 17, further comprising a back-up coiled tubing reel module that can be installed into the temperature controlled housing.

19. The system as recited in claim 16, wherein the coiled tubing reel module is transportable.

20. The system as recited in claim 19, wherein the coiled tubing reel module is mounted on a road legal trailer.

* * * * *